US006686898B2

(12) United States Patent
Chen et al.

(10) Patent No.: US 6,686,898 B2
(45) Date of Patent: Feb. 3, 2004

(54) DRIVING METHOD AND CIRCUIT OF ORGANIC LIGHT EMITTING DIODE

(75) Inventors: Yu-Zhong Chen, Yiilan (TW); Chih-Jung Yu, Yiilaj (TW); Chen-Ting Tsai, Peitou Chu (TW); Chieu-Yao Chin, Hsinchu (TW)

(73) Assignee: Delta Optoelectronics, Inc., Hsinchu (TW)

( * ) Notice: Subject to any disclaimer, the term of this patent is extended or adjusted under 35 U.S.C. 154(b) by 281 days.

(21) Appl. No.: 09/997,053

(22) Filed: Nov. 27, 2001

(65) Prior Publication Data

US 2003/0038761 A1 Feb. 27, 2003

(30) Foreign Application Priority Data

Aug. 24, 2001 (TW) ..... 90120809 A

(51) Int. Cl.[7] ..... G09G 3/20
(52) U.S. Cl. ..... 345/82; 345/55
(58) Field of Search ..... 345/82, 205, 83, 345/84, 46, 77, 39, 55, 63; 438/34, 14; 257/59; 365/175; 243/105; 315/169.3, 169.4; 313/384, 388, 427, 448

(56) References Cited

U.S. PATENT DOCUMENTS 6,055,180 A * 4/2000 Gudesen et al. ..... 365/175
6,229,508 B1 * 5/2001 Kane ..... 345/82
6,525,683 B1 * 2/2003 Gu ..... 341/140
2001/0055828 A1 * 12/2001 Kaneko et al. ..... 438/34
2003/0113942 A1 * 6/2003 Lin et al. ..... 438/14

* cited by examiner

*Primary Examiner*—Vijay Shankar
*Assistant Examiner*—Nitin Patel
(74) *Attorney, Agent, or Firm*—J.C. Patents

(57) ABSTRACT

Driving method and circuit of an organic light emitting diode, applied to an array of a plurality of organic light emitting diode. The array has several rows and columns of organic light emitting diodes. The row and column corresponding to the organic light emitting selected to illuminate are selected. A first voltage is applied to the selected column, and a second voltage is applied to the selected row. The difference between the first and second voltages is larger than the conducting voltage of the organic light emitting diode, so that the light emitting diode can illuminate. A third voltage and a fourth voltages are applied to other rows and columns which are not connected to the selected organic light emitting diode to provide a reverse bias to all the remaining light emitting diodes.

13 Claims, 2 Drawing Sheets

DRIVING METHOD AND CIRCUIT OF ORGANIC LIGHT EMITTING DIODE

CROSS-REFERENCE TO RELATED APPLICATION

This application claims the priority benefit of Taiwan application serial no. 90120809, filed Aug. 24, 2001.

BACKGROUND OF THE INVENTION

1. Field of the Invention

The invention relates in general to a light emitting diode (LED), and more particularly, to a driving method of an organic light emitting diode (OLED).

2. Description of the Related Art

To comply with the need for more versatile information equipment, the demand for flat panel displays (FPD) is rapidly increasing. The current trends of being light, thin, short and small have resulted in the replacement of cathode ray tubes (CRT) with flat panel displays. Currently, the major application of flat panel displays includes plasma display, liquid crystal display, electroluminescent display, light emitting diode, vacuum fluorescent display, field emission display, electrochromic display and organic light emitting diode.

The organic light emitting diode is further categorized into two types, a small molecular type and a polymer type. Due to the characteristics of (1) unlimited vision angle; (2) low fabrication cost; (3) high response speed (hundreds of times for the liquid crystal); (4) power saving; (5) drivable by direct current of portable machines; (6) wide temperature range; (7) light weight and sizable according to hardware specifications, the organic light emitting diode is meeting the requirements of the multimedia regime. Therefore, the organic light emitting diode possesses great potential in the flat panel display system and is the flat panel display for the next generation.

The driving method of the organic light emitting diode is not constant. Typically, the conducting voltage of the organic light emitting diode is 2.4V. In an array of organic light emitting diodes, a forward bias is applied to the light emitting diode which is to emit a light. For example, 6V is applied to the positive electrode and 0V is applied to the negative electrode. The organic light emitting diodes which do not emit are applied with a reverse bias. Normally, the pins of the remaining organic light emitting diodes are floating or connected to an unknown voltage, so that the organic light emitting diodes which do not emit are turned off. Alternatively, the current LCD driving chip can be used to drive the organic light emitting diodes. However, problems occur due to the difference between the structures.

Due to the unsure and incorrect driving method, the light emitting diode which is not supposed to illuminate emits a light. As a result, the organic light emitting diode panel cannot be driven normally. The different driving methods cause too much power consumption.

SUMMARY OF THE INVENTION

The invention provides a driving circuit and a driving method of an organic light emitting diode. A simple way to drive the organic light emitting diode panel is employed to enable the organic light emitting diode to illuminate. The units which are not supposed to illuminate are turned off without driving errors.

The driving circuit and method for an organic light emitting diode can also effectively reduce the power consumption.

In the driving circuit and method of an organic light emitting diode provided by the invention, an array with a plurality of light emitting diodes is provided. The array has a plurality of rows and columns. The column and row of a light emitting diode is selected. A first voltage is applied to the selected row, and a second voltage is applied to the selected column. A voltage difference between the first and second voltages is larger than a conducting voltage of the organic light emitting diodes. The selected light emitting diode can thus illuminate. Meanwhile, the first and second voltages are respectively applied to the remaining rows and columns which are not connected to the selected organic light emitting diode.

The invention provides another driving method of an organic light emitting diode applied to an array of a plurality of organic light emitting diodes. The array has a plurality of rows and a plurality of columns. The column and row of a light emitting diode is selected. A first voltage is applied to the selected row, and a second voltage is applied to the selected column. A voltage difference between the first and second voltages is larger than a conducting voltage of the organic light emitting diodes. The selected light emitting diode can thus illuminate. Meanwhile, a third and a fourth voltages are respectively applied to the remaining rows and columns which are not connected to the selected organic light emitting diode. Thereby, a reverse bias is applied to all the light emitting diodes which are not selected.

In the above method, the voltage difference between the first voltage and the second voltage is no less than the conducting voltage. The voltage difference between the first and third voltages is no larger than the conducting voltage. The voltage difference between the fourth and the third voltages is no larger than the conducting voltage.

The invention also provides a driving circuit of an organic light emitting diode including a plurality of organic light emitting diodes, a plurality of first voltage selectors and a plurality of second voltage selectors. The organic light emitting diodes are arranged as an array with a plurality of rows and a plurality of columns. The first voltage selectors are coupled to the columns of the array and select between the first and second voltages supplying to each column. The first voltage is larger than the second voltage. The second voltage selectors are connected to the rows of the array. The second voltage selectors are coupled to the rows of the array and select between the third and fourth voltages to supply to each row. The third voltage is larger than the fourth voltage. The voltage difference between the first voltage and the second voltage is not smaller than the conducting voltage of each of the organic light emitting diodes. The voltage difference between the fourth voltage and the second voltage is not larger than the conducting voltage. The voltage difference between the fourth and the third voltages is no larger than the conducting voltage.

Thereby, only the voltage across the organic light emitting diode to illuminate is larger than the conducting voltage. The voltages across the remaining organic light emitting diodes are smaller than the conducting voltage to ensure only the selected organic light emitting diode illuminates, while the neighboring light emitting diodes do not illuminate due to interference.

Both the foregoing general description and the following detailed description are exemplary and explanatory only and are not restrictive of the invention, as claimed.

DESCRIPTION OF THE PREFERRED EMBODIMENTS

The invention provides several circuits and methods to effectively drive an organic light emitting diode, whereby the neighboring light emitting diodes of a light emitting diode are not driven to mistakenly illuminate. The power saving objective is consequently achieved.

First Embodiment

Figure 1:
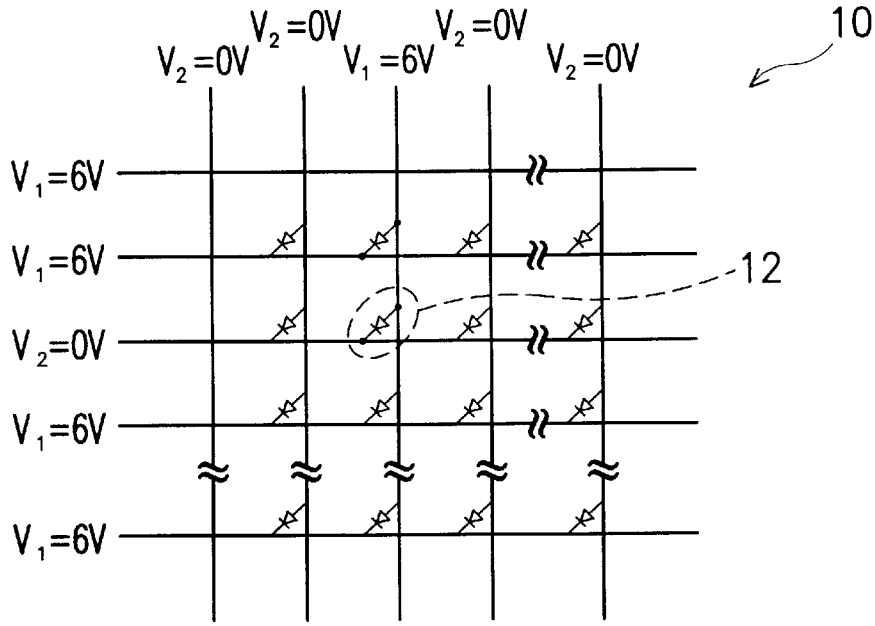
FIG. 1 shows the driving circuit and method of an organic light emitting diode in a first embodiment of the invention.

FIG. 1 shows the driving circuit and method of an organic light emitting diode in a first embodiment of the invention. In FIG. 1, an array 10 is formed including a plurality of rows and a plurality columns of organic light emitting diodes. Typically, only by applying a forward bias larger than the conducting voltage across the organic light emitting diode, can they then illuminate.

The organic light emitting diode 12 to illuminate is circled by a dashed line. The corresponding column and row of the organic light emitting diode 12 is selected. A first voltage V1 is applied to the selected column, while a second voltage V2 is applied to the selected row. The difference between the first voltage V1 and the second voltage V2 is larger than the conducting voltage of the organic light emitting diode 12. Thereby, the organic light emitting diode is conducted to illuminate. Meanwhile, the above first voltage V1 is applied to the remaining rows that are not connected to the organic light emitting diode 12, and the second voltage V2 is applied to the remaining columns that are not connected to the organic light emitting diode 12.

The conducting voltage of a normal organic light emitting diode is about 2.4V. To correctly drive the selected light emitting diode to illuminate without affecting the neighboring light emitting diodes, the first voltage V1 can be set at 6V, and the second voltage can be set at 0V. A forward bias of 6V is applied across the light emitting diode 12 and allows the light emitting diode 12 to illuminate. Meanwhile, the 6V voltage is also applied to the remaining rows that are not connected to the light emitting diode 12, while the 0V is applied to the remaining columns that are not connected to the light emitting diode 12. In addition to the light emitting diode 12, other light emitting diodes are experiencing a reverse bias of 6V. It is thus ensured that the remaining light emitting diodes do not illuminate.

The invention applies a first voltage V1 (6V) and a second voltage V2 (0V) to the negative and positive electrodes of all the light emitting diodes that do not illuminate. Therefore, apart from the selected light emitting diode, the remaining light emitting diodes are applied with a high reverse bias. The problem of mistakenly driving other light emitting diodes is prevented.

Second Embodiment

Figure 2:
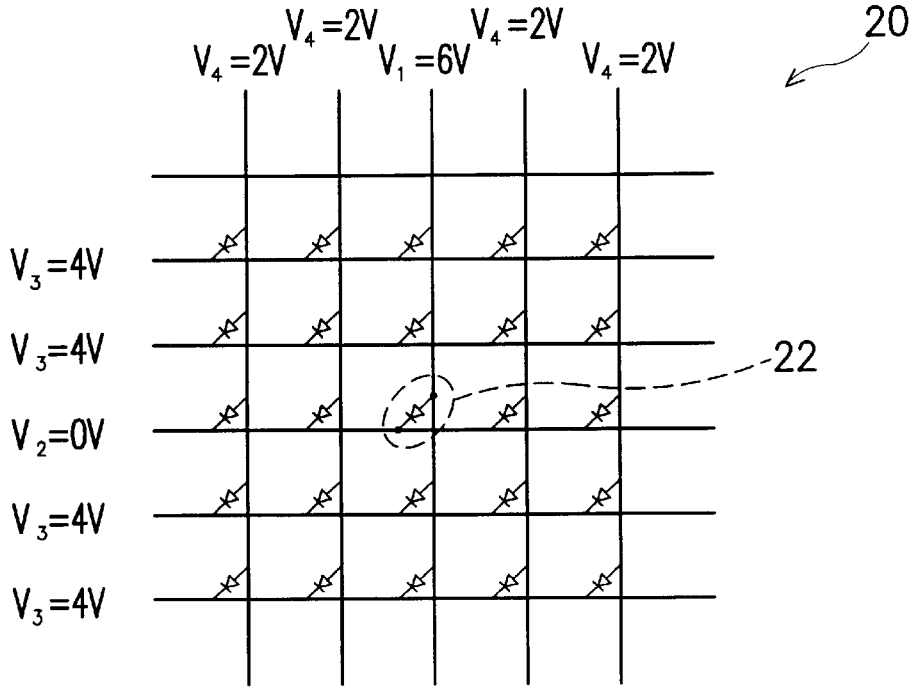
FIG. 2 shows the driving circuit and method of an organic light emitting diode in a second embodiment of the invention.

To further save the power consumed by driving the organic light emitting diode, a second driving method is provided in the invention. FIG. 2 shows the driving circuit and method of an organic light emitting diode of the invention. In FIG. 2, an array 20 of a plurality of rows and a plurality of columns of organic light emitting diodes is provided.

As shown in FIG. 2, the dashed line circles the light emitting diode 22 to illuminate. The column and row where the light emitting diode 22 is located is selected. A first voltage V1 is applied to the selected column, and a second voltage V2 is applied to the selected row. The voltage difference between the first and second voltages V1 and V2 is larger than a conducting voltage of the light emitting diodes. Meanwhile, a third voltage V3 is applied to the remaining columns which are not connected to the organic light emitting diode 22, and a fourth voltage V4 is applied to the remaining rows which are also not connected to the organic light emitting diode 22.

As mentioned in the first embodiment, to have the light emitting diode correctly driven to illuminate without affecting the neighboring light emitting diodes, the first voltage V1 is set as 6V, and the second voltage V2 is set as 0V, for example. In addition, the third voltage V3 can be set at 4V, and the fourth voltage V4 can be set at 6V. Therefore, the bias allows the light emitting diode 22 to illuminate, while the remaining light emitting diodes are suppressed with a reverse bias of 2V.

In this embodiment, the method to drive the light emitting diode 22 is similar to that of the first embodiment. The positive electrodes (the columns) and negative electrodes (the rows) that are not connected to the light emitting diode 22 are supplied with 2V and 4V, respectively. Therefore, in addition to the light emitting diode to illuminate, the remaining light emitting diodes are supplied with a high reverse bias, so that the problem of driving errors is prevented. By reducing the applied voltages from 6V to 4V and 2V, the power consumption is reduced.

Third Embodiment

Figure 3:
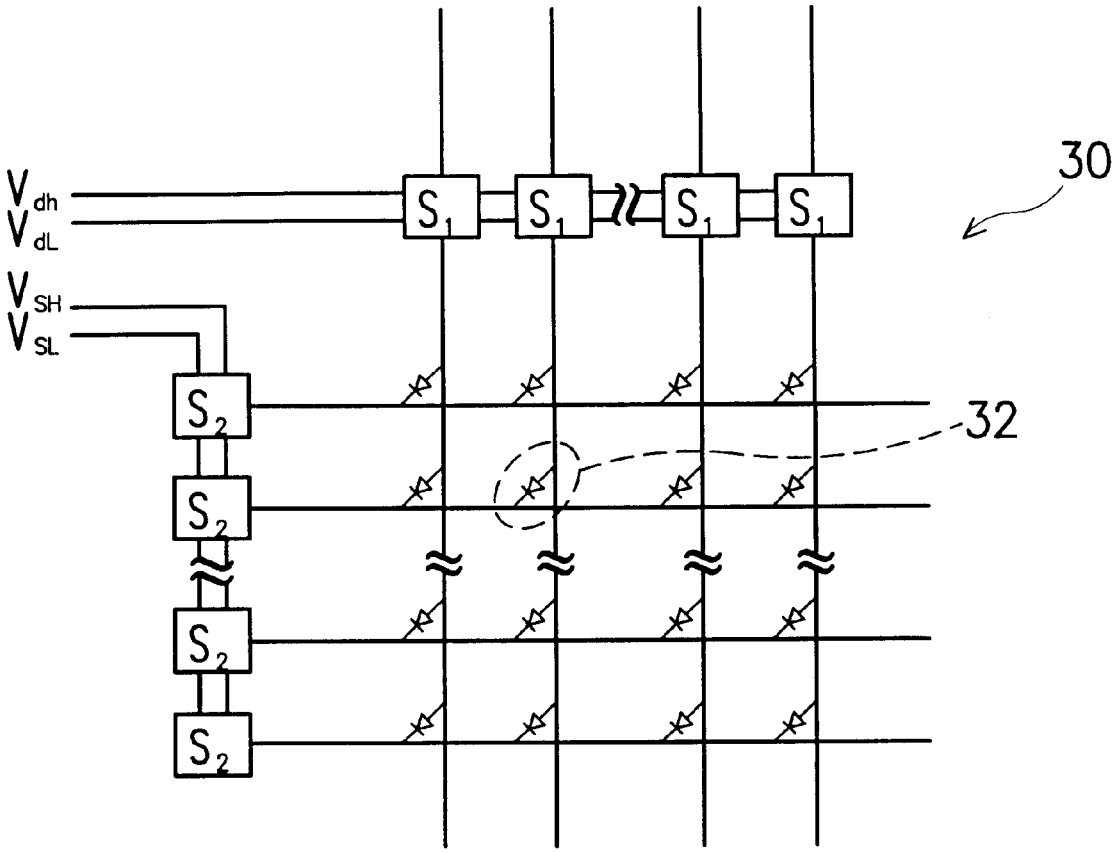
FIG. 3 shows the driving circuit and method of an organic light emitting diode in a third embodiment of the invention

FIG. 3 shows a circuit structure of the above two embodiments. In FIG. 3, only the essential circuit devices are illustrated, while other devices that do not affect the subject matter of the invention are not shown in FIG. 3.

In FIG. 3, the circuit comprises a plurality of light emitting diodes arranged in an array 30 with a plurality of rows and columns, a plurality of first voltage selectors S1 and a plurality of second voltage selectors S2. The first voltage selectors S1 are coupled to the columns and receive a first voltage $V_{dH}$ and a second voltage $V_{dL}$, either of which is selected to provide to each column. The first voltage $V_{dH}$ is larger than the second voltage $V_{dL}$. The second voltage selectors S2 are coupled to the rows and receive a third voltage $V_{sH}$ and a fourth voltage $V_{sL}$, either of which is selected to provide to each row. The third voltage $V_{sH}$ is larger than the fourth voltage $V_{sL}$.

The relationship between the first to fourth voltages is:

$V_{dH}-V_{sL} \geqq V_F$; $V_{dH}-V_{sH} \leqq V_F$ $V_{dL}-V_{sL} \geqq V_F$; $V_{dL}-V_{sH} \leqq V_F$ For example, when the organic light emitting diode 32 is selected to conduct, the corresponding column connected to the first voltage selector S1 selects the first voltage $V_{dH}$ to provide to the positive electrode of the light emitting diode 32. The first voltage selectors S1 connected to the remaining columns select the fourth voltage $V_{dL}$ to output. The second voltage selector S2 connected to a corresponding row provides the second voltage $V_{sL}$ to the negative electrode of the selected light emitting diode 32. The second voltage selectors S2 select the third voltage $V_{sH}$ to output.

Thus, the light emitting diode to be conducted is supplied with a forward bias of $V_{dH}-V_{sL}$, while the light emitting diodes which do not illuminate are connected to a reverse bias of $V_{sH}-V_{dL}$. Therefore, one can correctly drive the selected light emitting diode to illuminate without mistakenly driving surrounding light emitting diodes thereof.

According to the above, the invention has at least the following advantages and effects:

The driving method and circuit of an organic light emitting diode in the invention correctly drives the organic light emitting diode panel. Only the organic light emitting diode to be illuminated is conducted without affecting the neighboring ones. The abnormal illumination of the remaining organic light emitting diodes is thus avoided. The driving error is thus avoided.

Since the organic light emitting diode can be effectively driven, the power consumption can be reduced.

Other embodiments of the invention will appear to those skilled in the art from consideration of the specification and practice of the invention disclosed herein. It is intended that the specification and examples are to be considered as exemplary only, with a true scope and spirit of the invention being indicated by the following claims.

What is claimed is:

1. A driving method for an organic light emitting diode, applied to an array of a plurality of organic light emitting diodes arranged in a plurality of rows and a plurality of columns, the driving method comprising:

selecting a row and a column corresponding to one selected organic light emitting diode which is to illuminate;

applying a first voltage to the selected column and a second voltage to the selected row, wherein the first voltage is larger than the second voltage, and a difference between the first voltage and the second voltage is larger than a conducting voltage of the selected organic light emitting diode; and applying the first voltage to the remaining rows which are not connected to the selected organic light emitting diode, and applying the second voltage to the remaining columns which are not connected to the selected organic light emitting diode.

2. The driving method according to claim 1, wherein the conducting voltage is 2.4V.

3. The driving method according to claim 2, wherein the difference between the first voltage and the second voltage is 6V.

4. The driving method according to claim 1, wherein the first voltage is 6V and the second voltage is 0V.

5. A driving method for an organic light emitting diode, applied to an array of a plurality of organic light emitting diodes arranged in a plurality of columns and a plurality of rows, the driving method comprising:

selecting a row and a column corresponding to a selected organic light emitting diode;

applying a first voltage to the selected column, and a second voltage to the selected row, wherein the first voltage is larger than the second voltage, and a difference between the first voltage and the second voltage is larger than a conducting voltage of the selected organic light emitting diode; and respectively applying a third voltage and a fourth voltage to the remaining rows and columns which are not connected to the selected organic light emitting diode, such that a reverse bias is applied to the unselected organic light emitting diodes.

6. The driving method according to claim 5, wherein a difference between the third voltage and the fourth voltage is smaller than the conducting voltage.

7. The driving method according to claim 5, wherein the conducting voltage is 2.4V.

8. The driving method according to claim 7, wherein the difference between the first and second voltages is 6V.

9. The driving method according to claim 8, wherein the difference between the third and the fourth voltages is 2V.

10. The driving method according to claim 5, wherein the first voltage is 6V and the second voltage is 0V.

11. The driving method according to claim 10, wherein the third voltage is 4V and the fourth voltage is 2V.

12. The driving method according to claim 5, wherein the difference between the first and second voltages is no less than the conducting voltage, a difference between the first and third voltages is no larger than the conducting voltage, and a difference between the fourth and the third voltages is no larger than the conducting voltage.

13. A driving circuit of an organic light emitting diode, comprising:

a plurality of organic light emitting diodes, arranged in an array with a plurality of rows and a plurality of columns a plurality of first voltage selectors, coupled to the columns to receive a first and a second voltages, and select there between to provide to the columns, wherein the first voltage is larger than the second voltages; and a plurality of second voltage selectors, coupled to the rows to receive a third and a fourth voltages, and select there between to provide to the rows, wherein the third voltage is larger than the fourth voltage; wherein a difference between the first and the second voltages is no less than a conducting voltage of the organic light emitting diodes, a difference between the fourth and the second voltages is no larger than the conducting voltage, and a difference between the fourth and the third voltages is no larger then the conducting voltage.

* * * * *